US006550580B1

(12) United States Patent
Roches

(10) Patent No.: US 6,550,580 B1
(45) Date of Patent: Apr. 22, 2003

(54) FIRE ESCAPE SYSTEM

(76) Inventor: Wellington S. Roches, 114 S. 7th Ave., Mt Vernon, NY (US) 10530

( * ) Notice: Subject to any disclaimer, the term of this patent is extended or adjusted under 35 U.S.C. 154(b) by 0 days.

(21) Appl. No.: 09/965,717

(22) Filed: Sep. 27, 2001

(51) Int. Cl.[7] ..... A62B 1/20; E06B 7/28; A47L 3/04

(52) U.S. Cl. ..... 182/191; 182/5; 248/208

(58) Field of Search ..... 182/5, 3, 6, 36, 182/42, 43, 94, 70, 73, 76, 191, 190, 196, 189, 71, 100, 241; 254/390, 391, 389; 248/210, 211, 208, 200.1; 52/37

(56) References Cited

U.S. PATENT DOCUMENTS

| | | | | | |
|---|---|---|---|---|---|
| 187,569 | A | * | 2/1877 | Tixier | 182/71 |
| 404,514 | A | | 6/1889 | Worden | |
| 632,993 | A | | 9/1899 | Feiker | |
| 1,052,791 | A | * | 2/1913 | Bilger | 248/208 |
| 1,575,344 | A | * | 3/1926 | Klein | 182/73 |
| 1,583,055 | A | * | 5/1926 | Lane | 248/208 |
| 2,979,154 | A | * | 4/1961 | Bell | 182/73 |
| 3,294,196 | A | * | 12/1966 | Rabelos | 182/100 |
| 3,880,255 | A | | 4/1975 | Huntley | |
| 3,900,081 | A | * | 8/1975 | Dunston | 182/73 X |
| 4,161,998 | A | * | 7/1979 | Trimble | 182/100 X |
| 4,287,963 | A | | 9/1981 | Coxsey | |
| 4,425,982 | A | * | 1/1984 | Kibbis | 182/36 |
| 4,503,933 | A | | 3/1985 | O'neil | |
| 4,629,032 | A | * | 12/1986 | Armstrong | 182/82 X |
| 4,653,609 | A | * | 3/1987 | Devine | 182/71 X |
| 5,020,633 | A | * | 6/1991 | Rangel | 182/70 |
| 5,101,935 | A | * | 4/1992 | LaBianca | 182/42 X |
| D363,784 | S | | 10/1995 | Lund | |
| 6,233,877 | B1 | * | 5/2001 | Monroe | 248/208 X |

* cited by examiner

*Primary Examiner*—Daniel P. Stodola
*Assistant Examiner*—Hugh B. Thompson

(57) ABSTRACT

A fire escape system includes a frame assembly that is for coupling to a window frame. A suspension member is coupled to the frame assembly. The suspension member is suspended from the frame assembly such that the suspension member is for supporting a user escaping from the building. The suspension member is extendable between the frame assembly and the ground. A boom assembly is coupled to the frame assembly. The boom assembly has a support member. The support member of the boom assembly is coupled to the frame assembly. The suspension member is coupled to the boom assembly such that the boom assembly is for suspending the suspension member a distance from a wall of the building for inhibiting the user from is burned by the burning building.

20 Claims, 3 Drawing Sheets

FIG. 1
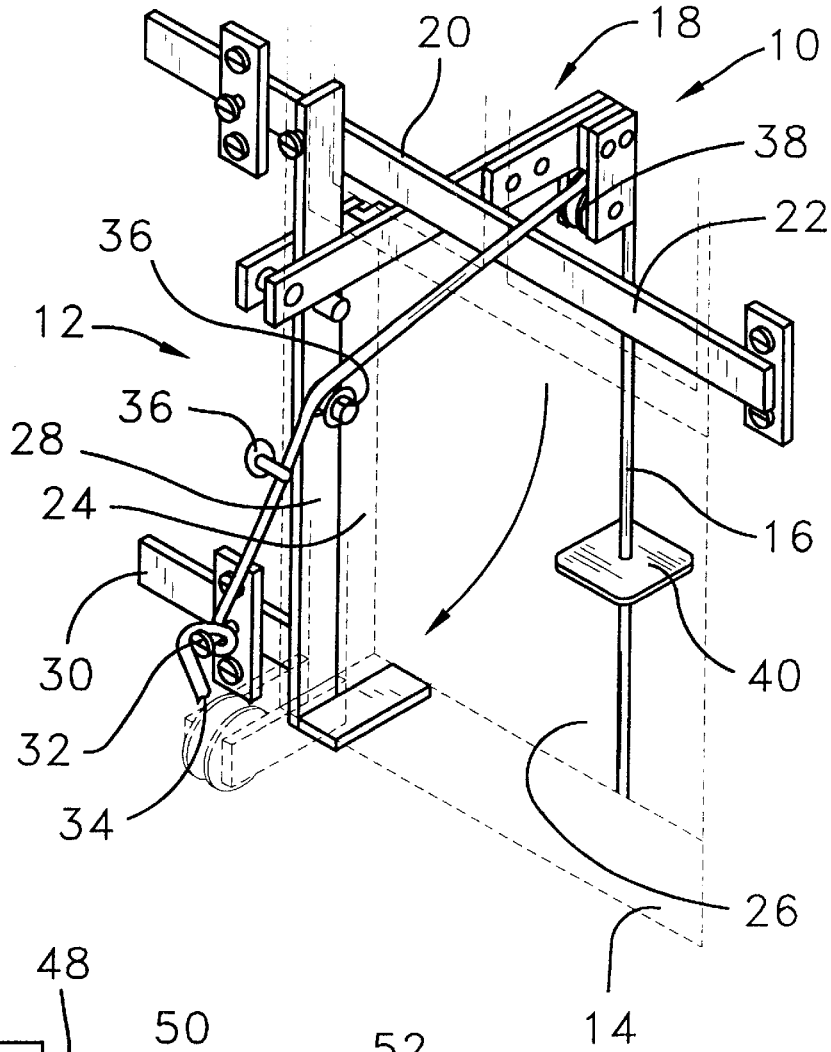
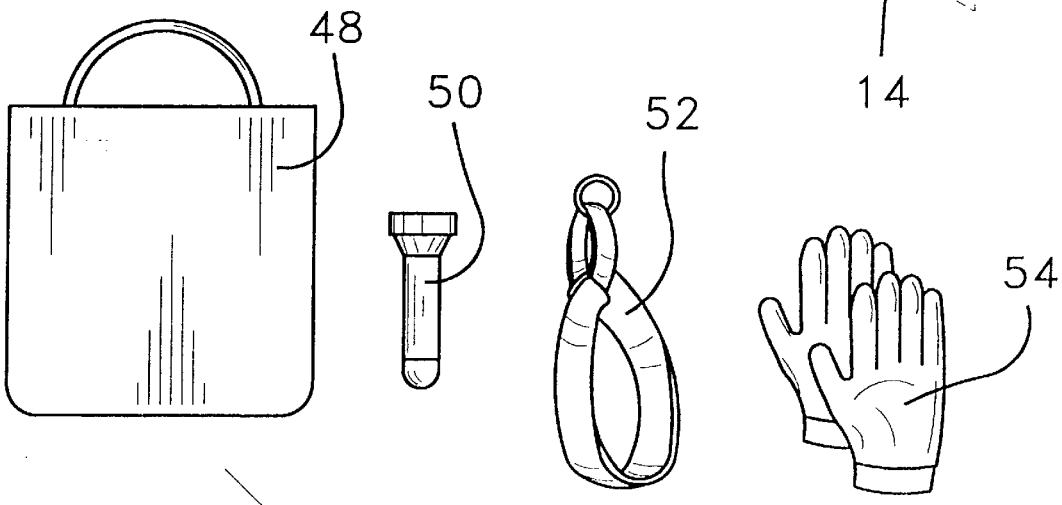
FIG. 4

FIRE ESCAPE SYSTEM

BACKGROUND OF THE INVENTION

1. Field of the Invention

The present invention relates to fire escape systems and more particularly pertains to a new fire escape system for providing a safe means for individuals to escape fires from various structures.

2. Description of the Prior Art

The use of fire escape systems is known in the prior art. More specifically, fire escape systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,880,255; 4,287,963; 4,503,933; 404,514; 632,993; and U.S. Pat. No. Des. 363,784.

While these devices fulfill their respective, particular objectives and requirements, the aforementioned patents do not disclose a new fire escape system. The inventive device includes a frame assembly that is adapted for coupling to a window frame. A suspension member is coupled to the frame assembly. The suspension member is suspended from the frame assembly such that the suspension member is adapted for supporting a user escaping from the building. The suspension member is extendable between the frame assembly and the ground. A boom assembly is coupled to the frame assembly. The boom assembly has a support member. The support member of the boom assembly is coupled to the frame assembly. The suspension member is coupled to the boom assembly such that the boom assembly is adapted for suspending the suspension member a distance from a wall of the building for inhibiting the user from is burned by the burning building.

In these respects, the fire escape system according to the present invention substantially departs from the conventional concepts and designs of the prior art, and in so doing provides an apparatus primarily developed for the purpose of providing a safe means for individuals to escape fires from various structures.

SUMMARY OF THE INVENTION

In view of the foregoing disadvantages inherent in the known types of fire escape systems now present in the prior art, the present invention provides a new fire escape system construction wherein the same can be utilized for providing a safe means for individuals to escape fires from various structures.

The general purpose of the present invention, which will be described subsequently in greater detail, is to provide a new fire escape system apparatus and method which has many of the advantages of the fire escape systems mentioned heretofore and many novel features that result in a new fire escape system which is not anticipated, rendered obvious, suggested, or even implied by any of the prior art fire escape systems, either alone or in any combination thereof.

To attain this, the present invention generally comprises a frame assembly that is adapted for coupling to a window frame. A suspension member is coupled to the frame assembly. The suspension member is suspended from the frame assembly such that the suspension member is adapted for supporting a user escaping from the building. The suspension member is extendable between the frame assembly and the ground. A boom assembly is coupled to the frame assembly. The boom assembly has a support member. The support member of the boom assembly is coupled to the frame assembly. The suspension member is coupled to the boom assembly such that the boom assembly is adapted for suspending the suspension member a distance from a wall of the building for inhibiting the user from is burned by the burning building.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new fire escape system apparatus and method which has many of the advantages of the fire escape systems mentioned heretofore and many novel features that result in a new fire escape system which is not anticipated, rendered obvious, suggested, or even implied by any of the prior art fire escape systems, either alone or in any combination thereof.

It is another object of the present invention to provide a new fire escape system, which may be easily and efficiently manufactured and marketed.

It is a further object of the present invention to provide a new fire escape system, which is of a durable and reliable construction.

An even further object of the present invention is to provide a new fire escape system which is susceptible of a low cost of manufacture with regard to both materials and labor, and which accordingly is then susceptible of low prices of sale to the consuming public, thereby making such fire escape system economically available to the buying public.

Still yet another object of the present invention is to provide a new fire escape system, which provides in the apparatuses and methods of the prior art some of the advantages thereof, while simultaneously overcoming some of the disadvantages normally associated therewith.

Still another object of the present invention is to provide a new fire escape system for providing a safe means for individuals to escape fires from various structures.

Yet another object of the present invention is to provide a new fire escape system, which includes a frame assembly that is adapted for coupling to a window frame. A suspension member is coupled to the frame assembly. The suspension member is suspended from the frame assembly such that the suspension member is adapted for supporting a user escaping from the building. The suspension member is extendable between the frame assembly and the ground. A boom assembly is coupled to the frame assembly. The boom assembly has a support member. The support member of the boom assembly is coupled to the frame assembly. The suspension member is coupled to the boom assembly such that the boom assembly is adapted for suspending the suspension member a distance from a wall of the building for inhibiting the user from is burned by the burning building.

Still yet another object of the present invention is to provide a new fire escape system that may be readied in a matter of seconds permitting an adult to help other adults and children reach safely to the ground.

Even still another object of the present invention is to provide a new fire escape system that can be produced in a wide range of sizes for fit most typical double-hung, sliding and other windows.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new fire escape system according to the present invention.

FIG. 4 is a perspective view of the present invention.

DESCRIPTION OF THE PREFERRED EMBODIMENT

Figure 2:
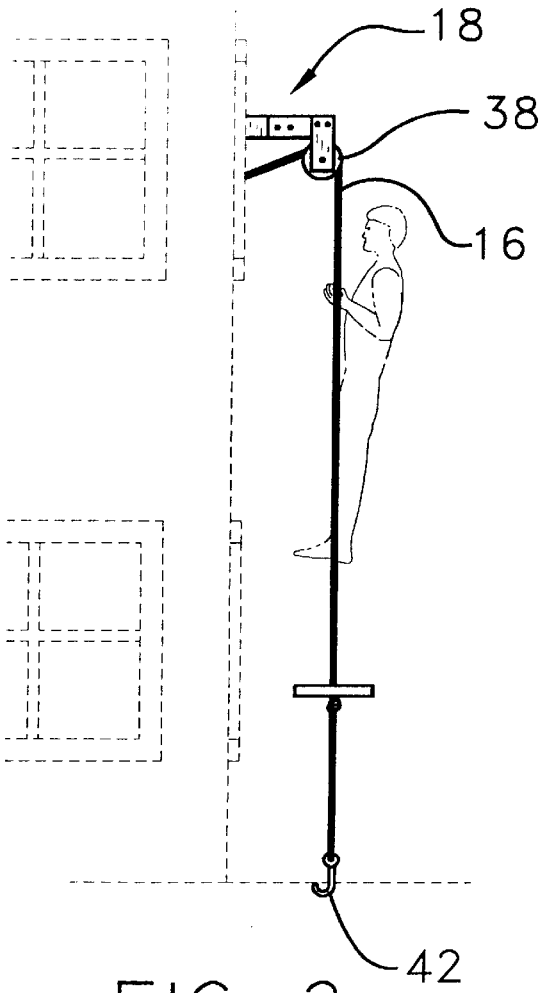
FIG. 2 is a side view of the present invention.
Figure 3:
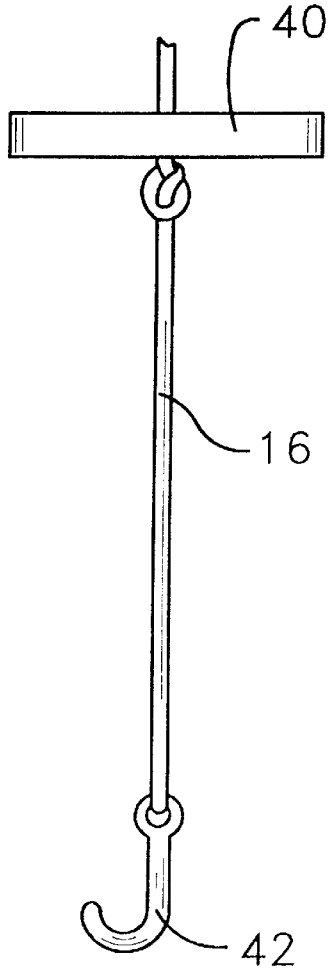
FIG. 3 is a side view of the present invention.
Figure 5:
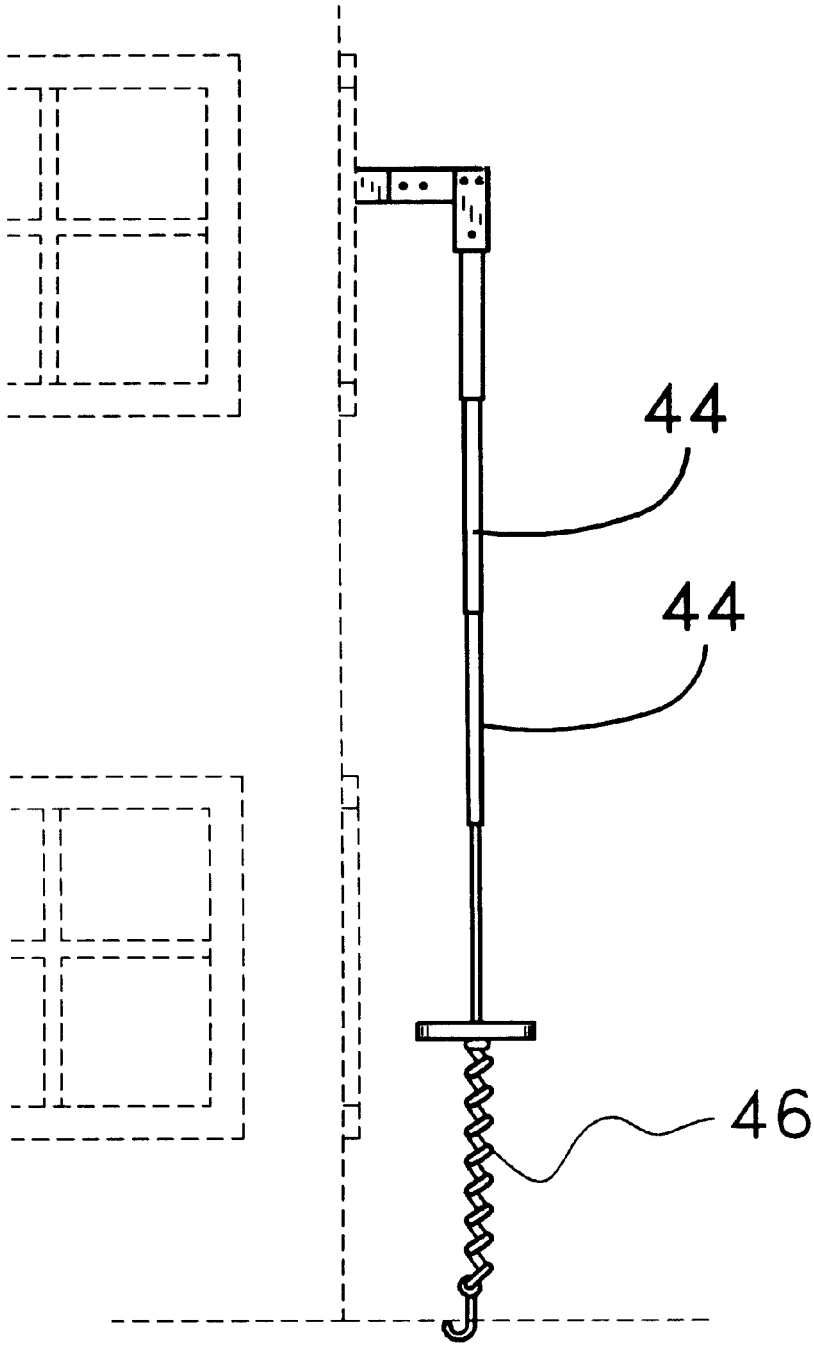
FIG. 5 is a side view of the present invention.

With reference now to the drawings, and in particular to FIGS. 1 through 5 thereof, a new fire escape system embodying the principles and concepts of the present invention and generally designated by the reference numeral 10 will be described.

As best illustrated, in, FIGS. 1 through 5, the fire escape system 10 generally includes a frame assembly 12 that is adapted for coupling to a window frame 14. A suspension member 16 is coupled to the frame assembly 12. The suspension member 16 is suspended from the frame assembly 12 such that the suspension member 16 is adapted for supporting a user escaping from the building. The suspension member 16 is extendable between the frame assembly 12 and the ground. A boom assembly 18 is coupled to the frame assembly 12. The boom assembly 18 has a support member 20. The support member 20 of the boom assembly 18 is coupled to the frame assembly 12. The suspension member 16 is coupled to the boom assembly 18 such that the boom assembly 18 is adapted for suspending the suspension member 16 a distance from a wall of the building for inhibiting the user from is burned by the burning building.

The frame assembly 12 has a base member 22, the base member 22 is adapted for coupling to a pair of side portions 24 of the window frame 14 such that the base member 22 is positioned across an opening 26 of the window frame 14, the base member 22 supporting the boom assembly 18 when the user is positioned on the suspension member 16.

The frame assembly 12 has a brace member 28, the brace member 28 is coupled to the base member 22, the base member 22 is adapted for is coupled to a lower end of one of the side portions 24 of the window frame 14 for inhibiting rotation of the brace member 28 with respect to the base member 22, the boom assembly 18 is selectively coupled to the brace member 28 such that the brace member 28 supports the boom assembly 18 when the user is positioned on the suspension member 16.

The brace member 28 of the frame assembly 12 has an anchor plate 30, the anchor plate 30 is adapted for coupling to one of the side portions 24 of the window frame 14 such that the anchor plate 30 anchors the brace member 28 to the window frame 14.

The anchor plate 30 of the brace member 28 has an anchoring pin 32, the anchoring pin 32 outwardly extends from the anchor plate 30, a free end 34 of the suspension member 16 is selectively securable to the anchoring pin 32 such that the anchoring pin 32 is for anchoring the suspension member 16 to the frame assembly 12.

The frame assembly 12 has a plurality of rollers 36, the rollers 36 is coupled to the brace member 28 of the frame assembly 12, the suspension member 16 selectively engaging the rollers 36 such that the rollers 36 are adapted for transferring force of a user positioned on the suspension member 16 into the frame assembly 12.

The boom assembly 18 has a pulley 38, the pulley 38 is pivotally coupled to the support member 20, the pulley 38 of the boom assembly 18 is for receiving the suspension member 16 such that the suspension member 16 is for facilitating extension of the suspension member 16 when the suspension member 16 is extended towards the ground.

A plate member 40 is slidably coupled to the suspension member 16, the plate member 40 is positioned above the ground when the suspension member 16 is extended to the ground, the plate member 40 is adapted for supporting feet of the user when the user has slid down the suspension member 16.

A hook member 42 is coupled to the suspension member 16 opposite the frame assembly 12; the hook member 42 is adapted for engaging the ground when the suspension member 16 is extended towards the ground such that the hook member 42 secures the suspension member 16 to the ground.

In and alternate embodiment the suspension member 16 includes a plurality of telescopic arms 44. The telescopic arms 44 each are for selectively extending and retracting for varying a length of the suspension member 16. One of the telescopic arms 44 is coupled to the support member 20 of the boom assembly 18.

A hook member 42 is coupled to the suspension member 16 opposite the frame assembly 12; the hook member 42 is adapted for engaging the ground when the suspension member 16 is extended towards the ground such that the hook member 42 secures the suspension member 16 to the ground.

The suspension member 16 has a biasing member 46. The biasing member 46 is positioned between the hook member 42 and the telescopic arms 44 of the suspension member 16.

The biasing member 46 is for biasing the telescopic arms 44 of the suspension member 16 when the user is positioned on the suspension member 16.

The present invention would also include a storage container 48 for storing accessories. Accessories would include a flashlight 50, a harness 52, and a pair of gloves 54.

In use, the present invention would be secured in a horizontal position at an intermediate point on a window frame via a series of lag bolts. A shorter bar and mounting bracket would be installed on the one lower side of the window frame in question in a similar manner. A flat, custom formed bar would be conformally mounted on the sill area of the window and secured to the surface of the exterior wall immediately outside it. These structural components could be used to mount a vertically oriented length of steel angle. Pivotally attached to it at a point near its upper end would be an adjustable length metal bar. A bracket and locking pin or upper bolt arrangement would be used to secure it in a horizontal orientation, with most of its length projecting out through the open window in question. Its lower outside end would feature a suitably heavy, enclosed pulley. The main vertical member would be fitted with one or more capstans or clevises to permit rope to be lowered in a controlled manner and tied off at an adjustable degree of extension.

The rope supplied with the unit could feature a hook that could permit its lower end to be secured to a point on the ground. Located just above this would be a large knot that could be used to support a square stop plate. The unit could also come with a harness, gloves and flashlight.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fire escape system for escaping a building on fire, the fire escape system comprising:

a frame assembly being adapted for coupling to a window frame;

a suspension member being coupled to said frame assembly, said suspension member being suspended from said frame assembly such that said suspension member is adapted for supporting a user escaping from the building, said suspension member being extendable between said frame assembly and the ground;

a boom assembly being coupled to said frame assembly, said boom assembly having a support member; said support member of said boom assembly being coupled to said frame assembly, said suspension member being coupled to said boom assembly such that said boom assembly is adapted for suspending said suspension member a distance from a wall of the building for inhibiting the user from being burned by the burning building;

said frame assembly having a base member, said base member being adapted for coupling to a pair of side portions of the window frame such that said base member is positioned across an opening of the window frame, said base member supporting said boom assembly when the user is positioned on said suspension member;

said frame assembly having a brace member, said brace member being coupled to said base member, said base member being adapted for being coupled to a lower end of one of the side portions of the window frame for inhibiting rotation of said brace member with respect to said base member, said boom assembly being selectively coupled to said brace member such that said brace member supports said boom assembly when the user is positioned on said suspension member;

said brace member of said frame assembly having an anchor plate, said anchor plate being adapted for coupling to one of the side portions of the window frame such that said anchor plate anchors said brace member to the window frame; and said anchor plate of said brace member having an anchoring pin, said anchoring pin outwardly extending from said anchor plate, a free end of said suspension member being selectively securable to said anchor pin such that said anchoring pin is for anchoring said suspension member to said frame assembly.

2. The fire escape system as set forth in claim 1, further comprising:

said frame assembly having a plurality of rollers, said rollers being coupled to said brace member of said frame assembly, said suspension member selectively engaging said rollers such that said rollers are adapted for transferring force of a user positioned on said suspension member into said frame assembly.

3. The fire escape system as set forth in claim 1, further comprising:

said boom assembly having a pulley, said pulley being pivotally coupled to said support member, said pulley of said boom assembly being for receiving said suspension member such that said suspension member is for facilitating extension of said suspension member when said suspension member is being extended towards the ground.

4. The fire escape system as set forth in claim 1, further comprising:

a plate member being slidably coupled to said suspension member, said plate member being positioned above the ground when said suspension member is extended to the ground, said plate member being adapted for supporting feet of the user when the user has slid down said suspension member.

5. The fire escape system as set forth in claim 1, further comprising:

a hook member being coupled to said suspension member opposite said frame assembly, said hook member being adapted for engaging the ground when said suspension member is extended towards the ground such that said hook member secures said suspension member to the ground.

6. The fire escape system as set forth in claim 1, further comprising:

said suspension member comprising a plurality of telescopic arms, said telescopic arms each being for selectively extending and retracting for varying a length of said suspension member, one of said telescopic arms being coupled to said support member of said boom assembly.

7. The fire escape system as set forth in claim 6, further comprising:

a hook member being coupled to said suspension member opposite said frame assembly, said hook member being adapted for engaging the ground when said suspension member is extended towards the ground such that said hook member secures said suspension member to the ground.

8. The fire escape system as set forth in claim 7, further comprising:

said suspension member having a biasing member, said biasing member being positioned between said hook member and said telescopic arms of said suspension member, said biasing member being for biasing said telescopic arms of said suspension member when the user is positioned on said suspension member.

9. The fire escape system as set forth in claim 1, further comprising:

wherein said frame assembly having a plurality of rollers, said rollers being coupled to said brace member of said frame assembly, said suspension member selectively engaging said rollers such that said rollers are adapted for transferring force of a user positioned on said suspension member into said frame assembly;

wherein said boom assembly having a pulley, said pulley being pivotally coupled to said support member, said pulley of said boom assembly being for receiving said suspension member such that said suspension member is for facilitating extension of said suspension member when said suspension member is being extended towards the ground;

wherein a plate member being slidably coupled to said suspension member, said plate member being positioned above the ground when said suspension member is extended to the ground, said plate member being adapted for supporting feet of the user when the user has slid down said suspension member; and wherein a hook member being coupled to said suspension member opposite said frame assembly, said hook member being adapted for engaging the ground when said suspension member is extended towards the ground such that said hook member secures said suspension member to the ground.

10. A fire escape system for escaping a building on fire, the fire escape system comprising:

a frame assembly being adapted for coupling to a window frame;

a suspension member being coupled to said frame assembly, said suspension member being suspended from said frame assembly such that said suspension member is adapted for supporting a user escaping from the building, said suspension member being extendable between said frame assembly and the ground;

a boom assembly being coupled to said frame assembly, said boom assembly having a support member; said support member of said boom assembly being coupled to said frame assembly, said suspension member being coupled to said boom assembly such that said boom assembly is adapted for suspending said suspension member a distance from a wall of the building for inhibiting the user from being burned by the burning building;

said frame assembly having a base member, said base member being adapted for coupling to a pair of side portions of the window frame such that said base member is positioned across an opening of the window frame, said base member supporting said boom assembly when the user is positioned on said suspension member;

said frame assembly having a brace member, said brace member being coupled to said base member, said base member being adapted for being coupled to a lower end of one of the side portions of the window frame for inhibiting rotation of said brace member with respect to said base member, said boom assembly being selectively coupled to said brace member such that said brace member supports said boom assembly when the user is positioned on said suspension member; and said frame assembly having a plurality of rollers, said rollers being coupled to said brace member of said frame assembly, said suspension member selectively engaging said rollers such that said rollers are adapted for transferring force of a user positioned on said suspension member into said frame assembly.

11. The fire escape system as set forth in claim 10, further comprising:

said boom assembly having a pulley, said pulley being pivotally coupled to said support member, said pulley of said boom assembly being for receiving said suspension member such that said suspension member is for facilitating extension of said suspension member when said suspension member is being extended towards the ground.

12. The fire escape system as set forth in claim 10, further comprising:

a plate member being slidably coupled to said suspension member, said plate member being positioned above the ground when said suspension member is extended to the ground, said plate member being adapted for supporting feet of the user when the user has slid down said suspension member.

13. The fire escape system as set forth in claim 10, further comprising:

a hook member being coupled to said suspension member opposite said frame assembly, said hook member being adapted for engaging the ground when said suspension member is extended towards the ground such that said hook member secures said suspension member to the ground.

14. The fire escape system as set forth in claim 10, further comprising:

said suspension member comprising a plurality of telescopic arms, said telescopic arms each being for selectively extending and retracting for varying a length of said suspension member, one of said telescopic arms being coupled to said support member of said boom assembly.

15. The fire escape system as set forth in claim 14, further comprising:

a hook member being coupled to said suspension member opposite said frame assembly, said hook member being adapted for engaging the ground when said suspension member is extended towards the ground such that said hook member secures said suspension member to the ground.

16. The fire escape system as set forth in claim 15, further comprising:

said suspension member having a biasing member, said biasing member being positioned between said hook member and said telescopic arms of said suspension member, said biasing member being for biasing said telescopic arms of said suspension member when the user is positioned on said suspension member.

17. A fire escape system for escaping a building on fire, the fire escape system comprising:

a frame assembly being adapted for coupling to a window frame;

a suspension member being coupled to said frame assembly, said suspension member being suspended from said frame assembly such that said suspension member is adapted for supporting a user escaping from the building, said suspension member being extendable between said frame assembly and the ground;

a boom assembly being coupled to said frame assembly, said boom assembly having a support member; said support member of said boom assembly being coupled to said frame assembly, said suspension member being coupled to said boom assembly such that said boom assembly is adapted for suspending said suspension member a distance from a wall of the building for inhibiting the user from being burned by the burning building;

said suspension member comprising a plurality of telescopic arms, said telescopic arms each being for selectively extending and retracting for varying a length of said suspension member, one of said telescopic arms being coupled to said support member of said boom assembly;

a hook member being coupled to said suspension member opposite said frame assembly, said hook member being adapted for engaging the ground when said suspension member is extended towards the ground such that said hook member secures said suspension member to the ground; and said suspension member having a biasing member, said biasing member being positioned between said hook member and said telescopic arms of said suspension member, said biasing member being for biasing said telescopic arms of said suspension member when the user is positioned on said suspension member.

18. The fire escape system as set forth in claim 17, further comprising:

said boom assembly having a pulley, said pulley being pivotally coupled to said support member, said pulley of said boom assembly being for receiving said suspension member such that said suspension member is for facilitating extension of said suspension member when said suspension member is being extended towards the ground.

19. The fire escape system as set forth in claim 18, further comprising:

a hook member being coupled to said suspension member opposite said frame assembly, said hook member being adapted for engaging the ground when said suspension member is extended towards the ground such that said hook member secures said suspension member to the ground.

20. The fire escape system as set forth in claim 17, further comprising:

a plate member being slidably coupled to said suspension member, said plate member being positioned above the ground when said suspension member is extended to the ground, said plate member being adapted for supporting feet of the user when the user has slid down said suspension member.

* * * * *